United States Patent [19]

Nakaniwa et al.

[11] Patent Number: 4,878,473

[45] Date of Patent: Nov. 7, 1989

[54] INTERNAL COMBUSTION ENGINE WITH ELECTRONIC AIR-FUEL RATIO CONTROL APPARATUS

[75] Inventors: Shinpei Nakaniwa; Akira Uchikawa, both of Kasukawa, Japan

[73] Assignee: Japan Electronic Control Systems Co. Ltd., Isesaki, Japan

[21] Appl. No.: 250,261

[22] Filed: Sep. 28, 1988

[30] Foreign Application Priority Data

Sep. 30, 1987 [JP] Japan ..... 62-243896

[51] Int. Cl.[4] ..... F02D 41/06

[52] U.S. Cl. ..... 123/489; 123/440

[58] Field of Search ..... 123/489, 440, 480, 492, 123/416, 417

[56] References Cited

U.S. PATENT DOCUMENTS

| | | | |
|---|---|---|---|
| 4,615,319 | 10/1986 | Tomisawa | 123/440 |
| 4,655,188 | 4/1987 | Tomisawa | 123/489 |
| 4,715,344 | 12/1987 | Tomisawa | 123/489 |
| 4,729,359 | 3/1988 | Tomisawa | 123/440 |
| 4,759,332 | 7/1988 | Worozuoni | 123/440 |
| 4,763,627 | 8/1988 | Tomisawa | 123/440 |
| 4,763,629 | 8/1988 | Okazaki et al. | 123/440 |
| 4,765,305 | 8/1988 | Hibmo et al. | 123/440 |
| 4,766,868 | 8/1988 | Shibate | 123/440 |
| 4,805,578 | 2/1989 | Kikuchi et al. | 123/489 |

*Primary Examiner*—Raymond A. Nelli

*Attorney, Agent, or Firm*—Sandler & Greenblum

[57] ABSTRACT

An electronic air-fuel ratio control apparatus in an internal combustion engine provided with an oxygen sensor emitting an output voltage in response to an oxygen concentration including the oxygen in nitrogen oxides in an exhaust gas from the engine. The apparatus controls the air-fuel ratio of an air-fuel mixture by a feedback correction-control based on a fuel injection quantity in an on-off manner. By using an oxygen sensor having a nitrogen oxides-reducing catalytic layer, the detection of a theoretical air-fuel ratio is performed on a richer side compared to the output on the detection of a theoretical air-fuel ratio by an oxygen sensor without the nitrogen oxides-reducing function, and is not changed even through the nitrogen oxides concentration changes. Accordingly, the feedback air-fuel ratio control acts to decrease the amount of nitrogen oxides so as to stabilixe the air-fuel ratio control. A first target air-fuel ratio for the air-fuel ratio feedback control is changed to a second target air-fuel ratio, which is richer than the first target air-fuel ratio when a high nitrogen oxide conentration in the exhaust gas is detected, or which is leaner than the first target air-fuel ratio when a high imcompletely burnt component concentration in the exhaust gas is detected.

18 Claims, 6 Drawing Sheets

INTERNAL COMBUSTION ENGINE WITH ELECTRONIC AIR-FUEL RATIO CONTROL APPARATUS

BACKGROUND OF THE INVENTION

1 Field of the Invention

The present invention relates to an air-fuel ratio control apparatus in which a fuel injection valve arranged in an intake passage of an internal combustion engine is pulse-controlled in an on-off manner, and an optimum air-fuel ratio in an air-fuel mixture drawn into the engine is obtained by electronic feedback control correction. More particularly, the present invention relates to an air-fuel ratio control apparatus in which the discharged amounts of nitrogen oxides ($NO_x$) and incompletely burnt components (CO, HC and the like) are reduced.

2 Description of the Related Art

As representative of the conventional air-fuel ratio electronic control apparatus in an internal combustion engine, there can be mentioned a control apparatus as disclosed in Japanese patent application Laid-Open specification No. 240840/85.

In this type of apparatus, a flow quantity Q of air drawn into the engine and the revolution number N of the engine are detected, and the basic fuel supply quantity Tp (=K.Q/N: where K is a constant) corresponding to the quantity of air drawn into a cylinder is computed. This basic fuel injection quantity is then corrected according to the engine driving states. For example the engine temperature and the like and the air-fuel ratio feedback correction coefficient LAMBDA are determined based on a signal from an oxygen sensor which detects the air-fuel ratio of the air-fuel mixture by detecting the oxygen concentration in the exhaust gas, and correction based on a battery voltage or the like is carried out, and a fuel injection quantity Ti (=Tp×COEF×LAMBDA+Ts) is finally set.

By sending a driving pulse signal of a pulse width corresponding to the thus set fuel injection quantity Ti to an electromagnetic fuel injection valve at a predetermined timing, a predetermined quantity of fuel is injected and supplied to the engine.

The air-fuel ratio feedback correction coefficient LAMBDA is set to adjust the air-fuel ratio in an air-fuel mixture sucked into the engine to a target air-fuel ratio (the theoretical air-fuel ratio). The LAMBDA is gradually changed in the manner of proportion and integration controls to attain stable, smooth control of the air-fuel ratio feedback. (The proportion control is generally recognized as belonging to the integration control.) The reason for adjusting the air-fuel ratio in the mixture to a value close to the theoretical air-fuel ratio is related to the conversion efficiency (purging efficiency) of a ternary catalyst disposed in the exhaust system to oxidize CO and HC (hydrocarbon) in the exhaust gas and reduce $NO_x$ for purging the exhaust gas. The efficiency of the catalyst is such that the highest effect is attained for an exhaust gas discharged when combustion is performed at the theoretical air-fuel ratio.

Accordingly, a system having a known sensor portion structure as disclosed in Japanese patent application Laid-Open specification No. 204365/83 may be used for the oxygen sensor.

This system comprises a ceramic tube having an oxygen ion-conducting property a platinum catalyst layer for promoting the oxidation reaction of CO and HC in the exhaust gas, which is laminated on the outer surface of the ceramic tube. $O_2$ left at a low concentration in the vicinity of the platinum catalyst layer on combustion of an air-fuel mixture richer than the theoretical air-fuel ratio is reacted with CO and HC to lower the $O_2$ concentration substantially to zero. This increases the difference between this reduced $O_2$ concentration and the $O_2$ concentration in the open air brought into contact with the inner surface of the ceramic tube, producing a large electromotive force between the inner and outer surfaces of the ceramic tube.

On the other hand, when an air-fuel mixture leaner than the theoretical air-fuel ratio is burnt, high-concentration $O_2$ and low-concentration CO and HC are present in the exhaust gas. Therefore, even after the reaction of $O_2$ with CO and HC, excessive $O_2$ is still present, and the difference of the $O_2$ concentration between the inner and outer surfaces of the ceramic tube is small, such that no substantial voltage is generated.

The generated electromotive force (output voltage) of the oxygen sensor is characterized in that the electromotive force changes abruptly in the vicinity of the theoretical air-fuel ratio, as pointed out above. This output voltage $V_{02}$ is compared with the reference voltage (slice level SL) to judge whether the air-fuel ratio of the air-fuel mixture is richer or leaner than the theoretical air-fuel ratio. For example, in the case where the air-fuel ratio is lean (rich), the air-fuel ratio feedback correction coefficient LAMBDA to be factored into the above-mentioned basic fuel injection quantity Ti is gradually increased (decreased) by a predetermined integration constant, i.e. The feedback control correction constant, whereby the air-fuel ratio is adjusted to a value close to the theoretical air-fuel ratio.

In practice, although the oxygen component in $NO_x$ should be detected as a part of the oxygen concentration in the exhaust gas, this oxygen cannot be detected by the oxygen sensor. Reversion of the electromotive force this tends to occur when the air-fuel ratio is by the oxygen component in $NO_x$ than the theoretical air-fuel ratio. The air-fuel ratio is accordingly controlled to an excessively lean value, whereby reduction of the conversion of $NO_x$ in the ternary catalyst is promoted.

Therefore, reduction of $NO_x$ is attempted by also performing EGR (exhaust gas recycle) control. However, mounting of an EGR apparatus results in increased cost, and the fuel rating is drastically reduced through reduction of the combustion efficiency by introduction of the exhaust gas.

Against this background, there has been proposed an oxygen sensor in which an $NO_x$-reducing catalyst layer containing rhodium or the like capable of promoting the reduction reaction of $NO_x$ in the exhaust gas is arranged. $NO_x$ is thus reduced, such that oxygen in $NO_x$ can be detected (see E. P. O. 267,764 A2 and E. P. O. 267,765 A2).

If this oxygen sensor is used, the electromotive force of the oxygen sensor is reversed at the true air-fuel ratio. This true air-fuel ratio is shifted to the rich side by the oxygen component in $NO_x$ compared to the theoretical air-fuel ratio at which the electromotive force is reversed when the oxygen sensor has no capacity to reduce $NO_x$. Accordingly, if this oxygen sensor is used, the air-fuel ratio is shifted to the rich side and adjusted to a value close to the true theoretical air-fuel ratio. Furthermore, since the air-fuel ratio is controlled to a substantially constant level irrespective of the value of the $NO_x$ concentration, the conversions of CO, HC and $NO_x$ are sufficiently increased in the ternary catalyst. The amounts discharged of CO and HC can thus be most effectively reduced and the $NO_x$ content can be effectively lowered, with the result that omission of the EGR apparatus becomes possible.

However, even in the case where the air-fuel ratio is thus controlled to the vicinity of the true theoretical air-fuel ratio, the $NO_x$, CO and HC (especially $NO_x$ and CO) conversions of the ternary catalyst change abruptly in the vicinity of this value. This is because of the above-mentioned characteristic of the ternary catalyst. The conversion is accordingly unstable because of the dispersion and the deterioration of parts. Since the air-fuel ratio is temporarily made much leaner or richer in the manner of frequency with respect to the theoretical air-fuel ratio, it is difficult to actually obtain high, stable conversions of the catalyst. From the above-mentioned view point, setting the target air-fuel ratio to a slightly leaner value than the theoretical air-fuel ratio would be considered desirable for an engine in which the combustion performance is inherently poor and incompletely burnt components CO and HC are easily formed by incomplete combustion. This is because high, stable conversions of CO and HC in the catalyst can be positively attained while the forming of NO components in the engine is reduced. On the other hand, in an engine in which the combustion performance is inherently good and the $NO_x$ components are easily formed while poor CO and HC components are formed, it would be considered desirable to set the target air-fuel ratio to a value slightly richer than the theoretical air-fuel ratio for attaining the high and stable conversion of $NO_x$ in the ternary catalyst.

Further, even the same engine has different driving states where CO and HC components are easily formed, or where $NO_x$ components are easily formed. Therefore, as in the above discussion, it is preferable to reset the target air-fuel ratio correspond to differences in the engine driving states.

Setting the target air-fuel ratio to slightly richer or leaner value in the air-fuel ratio feedback control should be carried out within a predetermined range of the theoretical air-fuel ratio for effectively reducing the CO, HC and $NO_x$ components in the exhaust gas. If the target air-fuel ratio is set to an extremely lean air-fuel ratio, the amount of CO component exhaust from the engine is reduced with the result that the reduction reaction between $NO_x$ and CO can hardly be performed. As a result the reversing point of the output voltage from the oxygen sensor can not be shift to any richer air-fuel ratio than is the case using the oxygen sensor without the $NO_x$ reducing capacity, and the function of reducing the $NO_x$ component amount using air-fuel ratio feedback control and the oxygen sensor with $NO_x$ reducing capacity is no more effectively performed.

If the target air-fuel ratio is set to an extremely rich air-fuel ratio beyond the predetermined range not only is the amount of CO and HC components increased, but the $NO_x$ reducing reaction in the $NO_x$ reducing oxygen sensor and the ternary catalyst is saturated.

Consequently, the target air-fuel ratio in the air-fuel ratio feedback control apparatus must be set to the optimum value within the predetermined air-fuel ratio range in order to reduce the CO and HC components and also $NO_x$ components when the air-fuel ratio feedback control apparatus includes the $NO_x$ reducing oxygen sensor.

SUMMARY OF THE INVENTION

The present invention is intended to solve the foregoing problems. It is therefore a primary object of the present invention to provide an air-fuel ratio control apparatus comprising an oxygen sensor with $NO_x$ reducing capacity, in which a target air-fuel ratio is set to an optimum value near the vicinity of the true theoretical air-fuel ratio. In this manner, the total amount discharged of CO, HC and $NO_x$ can be reduced with a good balance there among, under the action of the $NO_x$ reducing performance of the oxygen sensor with $NO_x$ reducing capacity, which is capable of shifting the reversing point of the output voltage from the oxygen sensor without $NO_x$ reducing capacity to the richer side.

Another object of the present invention is to provide an air-fuel ratio control apparatus comprising an oxygen sensor with $NO_x$ reducing capacity in which a target air-fuel ratio, having been set to a value close to the vicinity of the theoretical air-fuel ratio, is changed to a value slightly richer than the theoretical air-fuel ratio when a high $NO_x$ concentration in an exhaust gas from the engine is detected, or to a value slightly leaner than the theoretical air-fuel ratio when a high concentration of incompletely burnt CO and HC components is detected in the exhaust gas.

A further object of the present invention is to provide an air-fuel ratio control apparatus comprising an oxygen sensor with $NO_x$ reducing capacity in which a target air-fuel ratio having a value close to the vicinity of the theoretical air-fuel ratio is changed to a value slightly leaner than the theoretical air-fuel ratio when a high concentration of incompletely burnt CO and HC components is detected in the exhaust gas.

A still further object of the present invention is to change the target air-fuel ratio according to the amount formed of incompletely burnt CO or HC components.

Another object of the present invention is to change the target air-fuel ratio according to the amount formed of incompletely burnt CO or HC components, and the amount formed of $NO_x$.

A yet further object of the present invention is to set the target air-fuel ratio at a level richer or leaner than the theoretical air-fuel ratio in a driving state where the amount formed of $NO_x$ is large, and to set the target air-fuel ratio at a leaner level in the driving state where the amount formed of CO or HC is large.

In the present invention, the change and control of the target air-fuel ratio can be accomplished by changing and setting the reference value or slice level SL, with which the output value of the oxygen sensor provided with the reducing catalyst is compared.

Furthermore, in the present invention, the change and control of the target air-fuel ratio can be accomplished by changing and setting the feedback control constant in the feedback control means for eliminating the deviation of the actually detected air-fuel ratio from the target air-fuel ratio.

In accordance with the present invention, the above objects can be attained by an air-fuel ratio control apparatus in an internal combustion engine which comprises, as shown in FIG. 1, an oxygen sensor provided with a ternary catalyst and arranged in an exhaust passage to detect the oxygen concentration in an exhaust gas corresponding to the air-fuel ratio in an air-fuel mixture supplied to the engine. The oxygen sensor comprises a catalyst for reducing $NO_x$ (nitrogen oxides) having the characteristic that the output value is reversed in the vicinity of the target air-fuel ratio. The sensor further comprises control means for comparing the output value of the oxygen sensor with a value corresponding to a target air-fuel ratio and increasing or decreasing the fuel injection quantity to control the air-fuel ratio to a level close to the target air-fuel ratio, wherein target air-fuel ratio-setting means is disposed to set the target air-fuel ratio and to change the target air-fuel ratio to a level richer than the theoretical air-fuel ratio in the state where the $NO_x$ concentration in the exhaust gas is high, or to a level leaner than the theoretical air-fuel ratio in the state where the incompletely burnt CO or HC component concentration in the exhaust gas is high.

If this structure of the present invention is adopted, since the air-fuel ratio is set at a level richer than the theoretical air-fuel ratio in the state where the $NO_x$ concentration in the exhaust gas is the high, the amount of $NO_x$ discharged can be decreased and the $NO_x$ conversion in the ternary catalyst can be increased to a level close to the upper limit; while, since the air-fuel ratio is set at a level leaner than the theoretical air-fuel ratio in the state where the incompletely burnt CO or HC component concentration in the exhaust gas is high, the amount of CO or HC discharged is decreased, and the CO or HC conversion in the ternary catalyst can be increased.

The target air-fuel ratio can be set so that it is changed according to the amount of $NO_x$ generated, and CO or HC or when the amount generated of $NO_x$ and CO or HC; thus is large, the target air-fuel ratio can be set at a level richer than the theoretical air-fuel ratio, and when the amount generated of CO or HC is large, the target air-fuel ratio can be set at a leaner level.

In order to change the target air-fuel ratio, the reference value, with which the output value of the oxygen sensor provided with the $NO_x$ reducing catalyst is compared, may be changed, or the feedback control constant in the feedback control means may be changed so as to eliminate the deviation of the actually detected air-fuel ratio from the target air-fuel ratio.

The present invention will now be described in detail with reference to embodiments illustrated in the accompanying drawings. Changes and improvements of these embodiments are included within the technical idea of the present invention, so far as they do not depart from the scope of the claims.

DETAILED DESCRIPTION OF THE PREFERRED EMBODIMENTS

Figure 1:
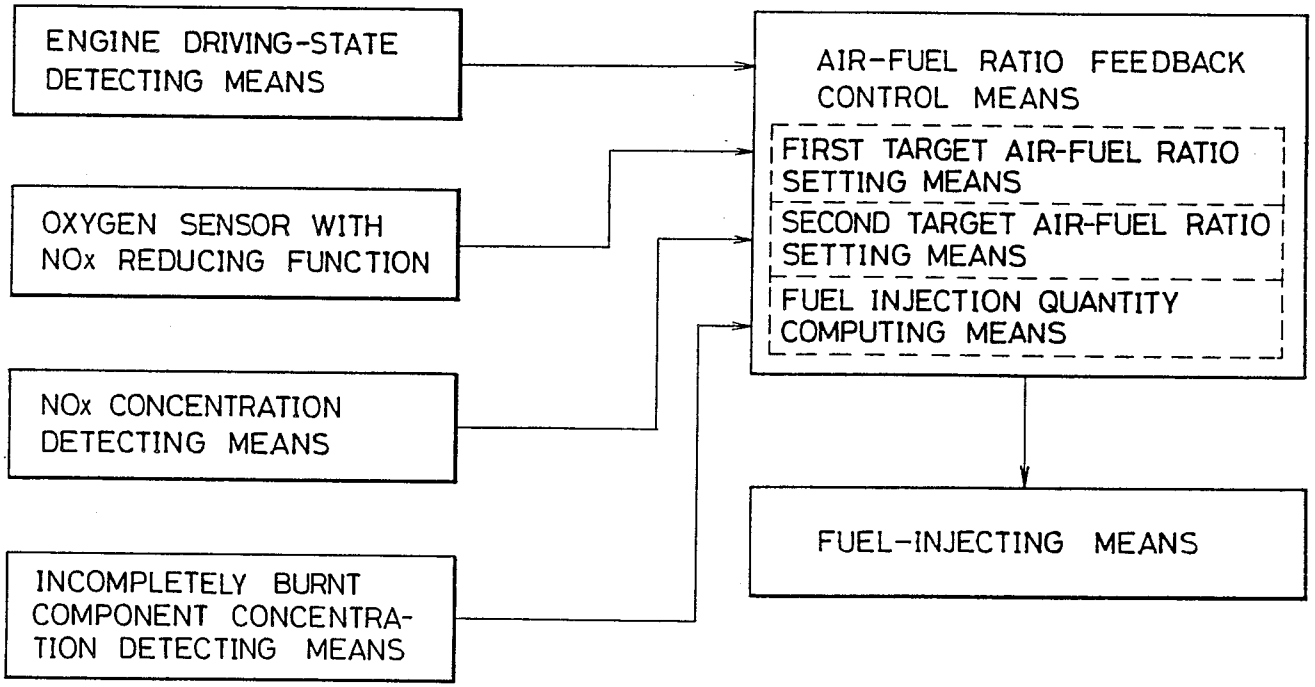
FIG. 1 is a block diagram illustrating the structure of the present invention.
Figure 2:
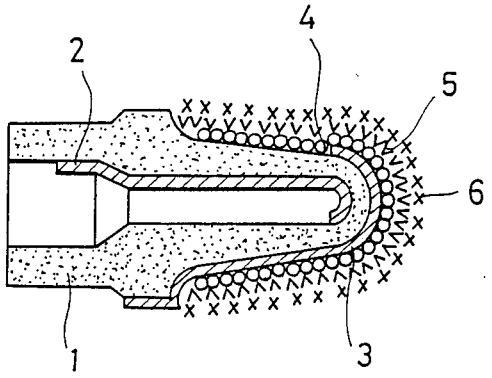
FIG. 2 is sectional view illustrating the main part of an oxygen sensor used in one embodiment of the present invention.

FIG. 2 illustrates the structure of a sensor portion of an oxygen sensor used in one embodiment of the present invention.

Referring to FIG. 2, inner and outer electrodes 2 and 3 composed of platinum are formed on parts of the inner and outer surfaces of a ceramic tube 1, as the substrate. The ceramic tube is composed mainly of zirconium oxide ($ZrO_2$), which is a solid electrolyte having an oxygen ion-conducting property, and has a closed top end portion. Furthermore, a platinum catalyst layer 4 is formed on the surface of the ceramic tube 1 by vacuum deposition of platinum. The platinum catalyst layer 4 is an oxidation catalyst layer for promoting the oxidation reaction of CO and HC in the exhaust gas.

A $NO_x$-reducing catalyst layer 5 (having, for example, a thickness of 0.1 to 5 $\mu$m) is formed on the outer surface of the platinum catalyst layer 4 by incorporating particles of a catalyst for promoting the reduction reaction of nitrogen oxides $NO_x$, such as rhodium Rh or ruthenium Ru (in an amount of, for example, 1 to 10%), into a carrier such as titanium oxide $TiO_2$ or lanthanum oxide $La_2O_3$. A metal oxide such as magnesium spinel is flame-sprayed on the outer surface of the $NO_x$-reducing catalyst layer 5 to form a protecting layer 6 for protecting the platinum catalyst layer 4 and the $NO_x$-reducing catalyst layer 5.

Rhodium Rh and ruthenium Ru are known as catalysts for reducing nitrogen oxides $NO_x$, and it has been experimentally confirmed that if titanium oxide $TiO_2$ or lanthanum oxide $La_2O_3$ is used as the carrier for this catalyst, the reduction reaction of $NO_x$ can be performed much more efficiently than in the case where $\gamma$-alumina or the like is used as the carrier. Incidentally, in the oxygen sensor shown in FIG. 2, the protecting layer 6 is formed on the outer surface of the reducing catalyst layer 5, but there may be adopted a modification in which the protecting layer 6 is formed between the platinum catalyst layer 4 and the $NO_x$-reducing catalyst layer 5.

In the above-mentioned structure, when nitrogen oxides $NO_x$ contained in the exhaust gas arrive at the $NO_x$-reducing catalyst layer 5, the $NO_x$-reducing catalyst layer 5 promotes the following reactions of $NO_x$ with unburnt CO and components in the exhaust gas:

$$NO_x + CO \rightarrow N_2 + CO_2$$

$$NO_x + HC \rightarrow N_2 + H_2O + CO_2$$

As the result, the amounts of the unburnt components CO and HC to be reacted with $O_2$ arriving at the platinum catalyst layer 4 located on the inner side of the $NO_x$-reducing layer 5 are reduced by the above reactions in the $NO_x$-reducing catalyst layer 5, and the $O_2$ concentration is accordingly increased.

Therefore, the difference between the $O_2$ concentration on the inner side of the ceramic tube 1 falling in contact with the open air and the $O_2$ concentration on the exhaust gas side is reduced, and consequently the electromotive force of the oxygen sensor is reversed below the reference value (slice level) and reduced on the side richer than in the conventional oxygen sensor in which the $NO_x$ components in the exhaust gas are not reduced, with the result that lean detection can be performed.

Accordingly, if the feedback control of the air-fuel ratio is carried out based on the detection results (the results of the judgement as to whether the air-fuel mixture is rich or lean) of this oxygen sensor, the air-fuel ratio is controlled to a rich level closer to the true theoretical air-fuel ratio, obtained by detecting the oxygen concentration while taking the oxygen component of $NO_x$ into account.

The $NO_x$-reducing catalyst layer 5 a function of promoting the reaction of the unburnt components CO and HC with $O_2$. However, since this function is substituted for the function of the platinum catalyst layer 4, the $O_2$ concentration on the exhaust gas side is not reduced.

An embodiment of the apparatus of the present invention for controlling the air-fuel ratio in an internal combustion engine by using the above-mentioned oxygen sensor provided with the $NO_x$-reducing catalyst will now be described.

Figure 3:
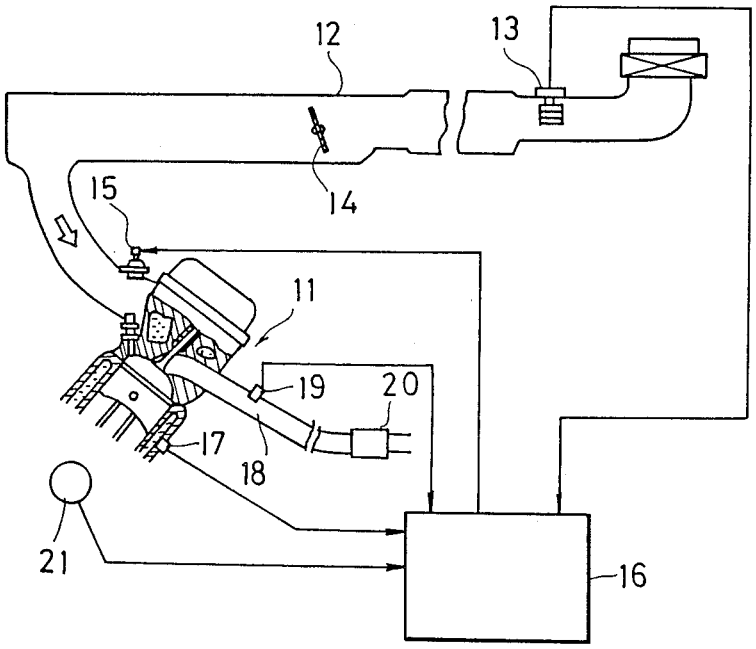
FIG. 3 is a diagram illustrating the system of the embodiment shown in FIG. 2.

Referring to FIG. 3, an air flow meter 13 for detecting the drawn air flow quantity Q, and a throttle valve 14 for controlling the drawn air flow quantity Q in cooperation with an accelerator pedal, are arranged on an intake passage 12 of an engine 11, and electromagnetic fuel injection valves 15 for respective cylinders are arranged in a manifold portion located downstream. Each fuel injection valve 15 is opened and driven by an injection pulse signal from a control unit 16 having a microcomputer built therein to inject and supply a fuel fed under a pressure from a fuel pump not shown in the drawings and maintained under a predetermined pressure controlled by a pressure regulator. Moreover, a water temperature sensor 17 is arranged for detecting the cooling water temperature Tw in a cooling jacket of the engine 11, and an oxygen sensor 19 (see FIG. 2 with respect to the structure of the sensor portion) is disposed for detecting an air-fuel ratio in a drawn air-fuel mixture by detecting the oxygen concentration in an exhaust gas in an exhaust passage 18. Furthermore, there is arranged a ternary catalyst 20 for purging the exhaust gas by performing oxidation of CO and HC and reduction of $NO_x$ in the exhaust gas on the downstream side. A crank angle sensor 21 is built in a distributor not shown in the drawings, and the revolution number of the engine is detected by counting, for a predetermined time, crank unit angle signals put out from the crank angle sensor 21 synchronously with the revolution of the engine, or by measuring the frequency of crank reference angle signals.

Figure 4:
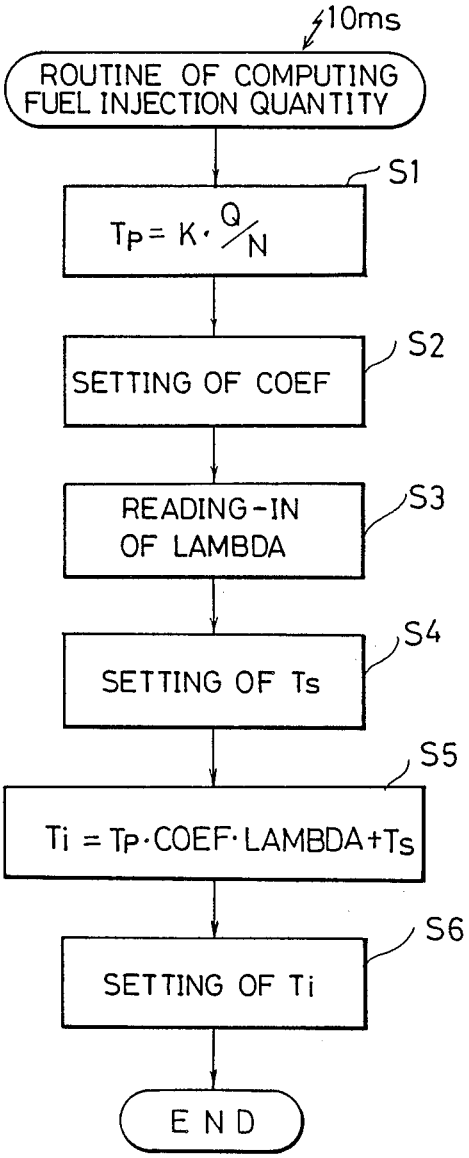
FIG. 4 is a flow chart showing a fuel injection quantity control routine in the embodiment shown in FIG. 2.

The method of control of the air-fuel ratio by the control unit 16 will now be described with reference to the flow chart shown in FIG. 4, which illustrates the fuel injection quantity-computing routine. This routine is carried out at a predetermined frequency (for example, 10 ms).

At step (indicated by "S" in the drawings) 1, the basic fuel injection quantity Tp corresponding to the flow quantity Q of drawn air per unit revolution is computed from the drawn air flow quantity Q detected by the air flow meter 13, and the engine revolution number N calculated from the signal from the crank angle sensor 21, according to the following formula:

$$Tp = K \times Q/N \text{ (K is a constant)}$$

At step 2, various correction coefficients COEF are set based on the cooling water temperature Tw detected by the water temperature sensor 17 and other factors.

At step 3, the feedback correction coefficient LAMBDA, set based on the signal from the oxygen sensor 19 by the feedback correction coefficient-setting routine described hereinafter, is read in.

At step 4, the voltage correction portion Ts is set based on the voltage value of the battery. This is to correct the change of the injection quantity in the fuel injection valve 15 by the change of the battery voltage.

At step 5, the final fuel injection quantity Ti is computed according to the following formula:

$$Ti = Tp \times \text{COEF} \times \text{LAMBDA} + Ts$$

At step 6, the computed fuel injection quantity Ti is set at the output register. The portion including steps 5 and 6 shows a fuel injection quantity computing means. The engine driving state detecting means includes the air flow meter 13, the crank angle sensor 21, the water temperature sensor 17 and others.

According to the above-mentioned method, a driving pulse signal having a pulse width corresponding to the computed fuel injection quantity Ti is sent to the fuel injection valve 15 at a predetermined timing synchronous with the revolution of the engine to effect injection of the fuel.

Figure 5:
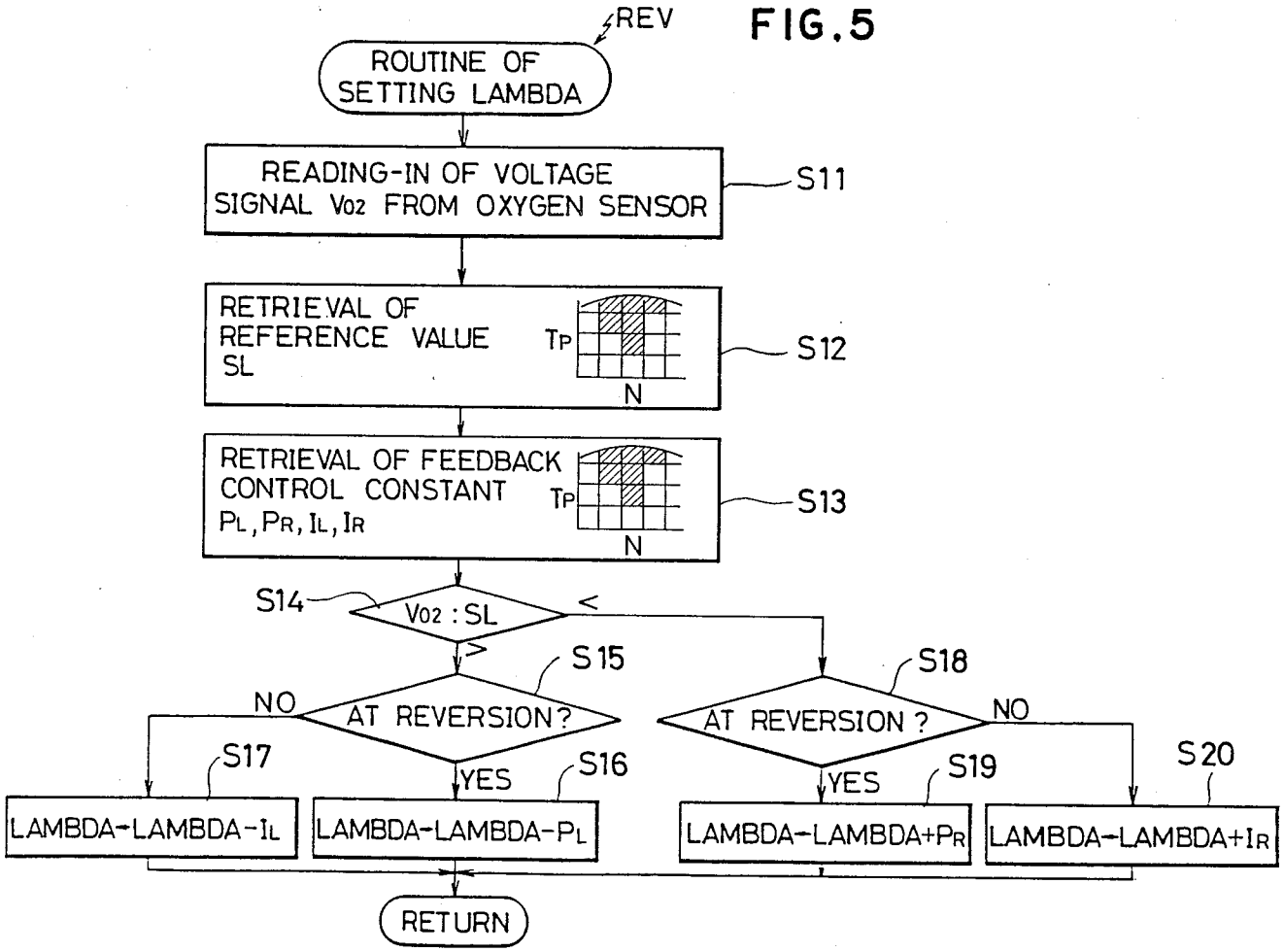
FIG. 5 is a flow chart showing a feedback correction coefficient-setting routine in the embodiment shown in FIG. 2.

The air-fuel ratio feedback control correction coefficient LAMBDA-setting routine having the feedback control constant-setting function according to the present invention will now be described with reference to FIG. 5. This routine is carried out synchronously with the revolution of the engine and shows an air-fuel ratio feedback control means incorporated with the routine shown in FIG. 4.

At step 11, the signal voltage $V_{02}$ from the oxygen sensor 19 is read in.

Figure 9:
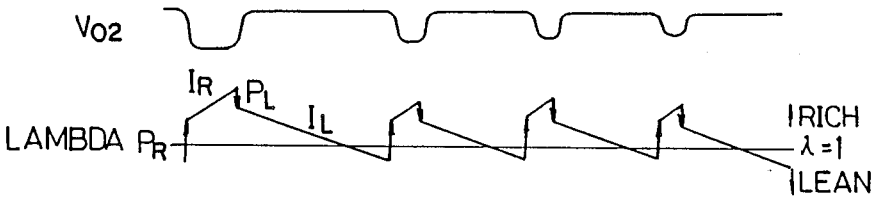
FIGS. 9 and 10 are time charts respectively illustrating the changes of the feedback correction coefficient and the output voltage of the oxygen sensor at the time of the control in the embodiment of the present invention.
Figure 10:
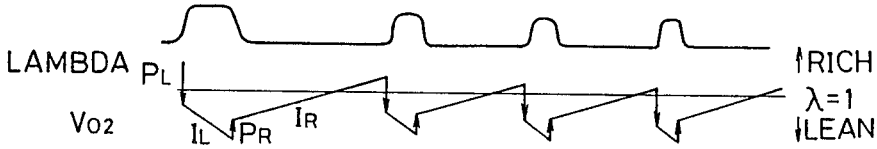

At step 12, the feedback control constant is retrieved from the map stored in ROM based on the newest data of the present engine revolution number N and basic fuel injection quantity Tp. As described below in FIGS. 9 and 10, the feedback control constant comprises the first proportion constant $P_R$ to be added for correcting the increase of the fuel injection quantity just after the rich air-fuel ratio has been reversed to the lean air-fuel ratio, and the first integration constant $I_R$ to be added for correction of increase of the fuel injection quantity at times other than the point just after the above-mentioned reversal of the air-fuel ratio. Furthermore, the feedback control constant comprises the second proportion constant $P_L$ to be subtracted for correcting the decrease of the fuel injection quantity just after the lean air-fuel ratio has been reversed to the rich air-fuel ratio, and the second integration constant $I_L$ to be subtracted for correcting the of decrease of the fuel injection quantity at times other than the point just after the above-mentioned reversion of the air-fuel ratio. In short, the feedback control constant includes two kinds of constants, each of which has the integration constant and the proportion constant. The proportion constant is generally deemed as a kind of integration constant.

Feedback control constants $P_R$, $P_L$, $I_R$ and $I_L$ are rewritably stored in driving state regions which are arranged on the map in the manner of a grid based on N and Tp. In the region among them where a high combustion temperature in cylinders of the engine and hence a high concentration of $NO_x$ in the exhaust gas are experimentally detected, first feedback control constants $P_R$ and $I_R$ for increasing the fuel injection quantity are set at a larger value than second feedback control constants $P_L$ and $I_L$ for decreasing the fuel injection quantity respectively, or set so that $P_R/P_L$ and $I_R/I_L$ are larger than 1 and have a tendency of increasing. In the region where the combustion performance in the engine is not good and hence a high concentration of the incompletely burnt components CO and HC are experimentally emitted, first feedback control constants $P_R$ and $I_R$ are set at a smaller value than second feedback control constants $P_L$ and $I_L$ respectively, or set so that $P_R/P_L$ and $I_R/I_L$ are larger than 1 and have a tendency of decreasing. In each of the other driving state regions, $P_R$ and $I_R$ are mutually set at even values and also $P_L$ and $I_L$ are set at even values. Then the routine goes into step 13. As is apparent from the explanation of step 12, it is understood that the step 12 corresponds to a nitrogen oxides concentration detecting means and an incompletely burnt component concentration detecting means of the present invention as in step 13, which is hereinafter explained.

At step 13, the reference value SL (slice level), with which the signal voltage $V_{02}$ from the oxygen sensor is to be compared, is retrieved from the map stored in ROM based on the newest data of the present engine revolution number N and the basic fuel injection quantity Tp. This step 13 corresponds to a first target air-fuel ratio setting means according to the present invention. In this map, the driving region is finely divided by N and Tp, and in the region where the combustion temperature is high and the $NO_x$ discharge concentration is increased (experimentally determining and retrieving this region corresponds to a nitrogen oxides concentration detecting means according to the present invention as in step 12), the second reference value $SL_H$ of a relatively high voltage corresponding to an air-fuel ratio richer up to 5% than the true theoretical air-fuel ratio is set, In the region where the combustion performance in the engine is not good, and hence a high concentration of the incompletely burnt components CO and HC are emitted in the experimental determination, a second slice level $SL_L$ is set at a lower level than the value corresponding to the theoretical air-fuel ratio, so that the second slice level $SL_L$ corresponds to an air-fuel ratio leaner by up to 5% than the theoretical air-fuel ratio. These functions correspond to a second target air-fuel setting means according to the present invention. In the other region where the $NO_x$, CO and HC concentrations are relatively low, the first reference value $SL_O$ of a voltage corresponding to the true theoretical air-fuel ratio is set. Instead of this two-staged settings, other setting can be optionally set according to the $NO_x$ concentration.

Then, the routine goes into step 14, and the signal voltage $V_{02}$ read in at step 11 is compared with the reference value SL ($SL_O$, $SL_H$ or $SL_L$) retrieved at step 13.

In the case where the air-fuel ratio is rich ($V_{02}>SL$), the routine goes into step 15, and it is judged whether or not the lean air-fuel ratio has been reversed to the rich air-fuel ratio. When a reversal is determined the feedback correction coefficient LAMBDA is decreased at step 16 by a predetermined proportion constant $P_L$. When a nonreversal is determined, the routine goes into step 17 and the precedent value of the feedback correction coefficient LAMBDA is decreased by a predetermined integration constant $I_L$.

When it is judged at step 14 that the air-fuel ratio is lean ($V_{02}<SL$), the routine goes into step 18 and it is similarly judged whether or not the rich air-fuel ratio has been reversed to the lean air-fuel ratio. When a reversal is detected, the routine goes into step 19 and the feedback correction coefficient LAMBDA is increased by a predetermined proportion $P_R$. When a non-reversal is determined, the routine goes into step 20 and the precedent value is increased by a predetermined integration constant $I_R$.

Thus, the feedback correction coefficient LAMBDA is increased or decreased at a certain gradient. Incidentally, the relation of $I<<P$ is established. (In general, the proportion constant P is included in the integration constant I.)

The step 14 corresponds to an air-fuel ratio judging means according to the present invention. When $P_R$ and $I_R$ are even and $P_L$ and $I_L$ are even, maps of feedback control constants $P_R$, $I_R$, $P_L$ and $I_L$ stored in ROM at step 12 and of the slice levels $SL_O$ stored in ROM at step 13 and the functions of retrieving and setting the slice level $SL_O$ at step 13, retrieving feedback control constants $P_R$, $I_R$, $P_L$ and $I_L$, and setting feedback control coefficient LAMBDA at steps 12, 16, 17, 19 and 20, correspond to a first target air-fuel ratio setting means according to the present invention. When $P_R$ and $I_R$ are different and $P_L$ and $I_L$ are different from each other, maps at step 12 and step 13, and functions of retrieving and setting the slice levels $SL_H$ and $SL_L$ at step 13, retrieving $P_R$, $I_R$, $P_L$ and $I_L$, and setting feedback correction coefficient LAMBDA at steps 12, 16, 17, 19 and 20 correspond to a second air-fuel ratio setting means according to the present invention.

Figure 7:
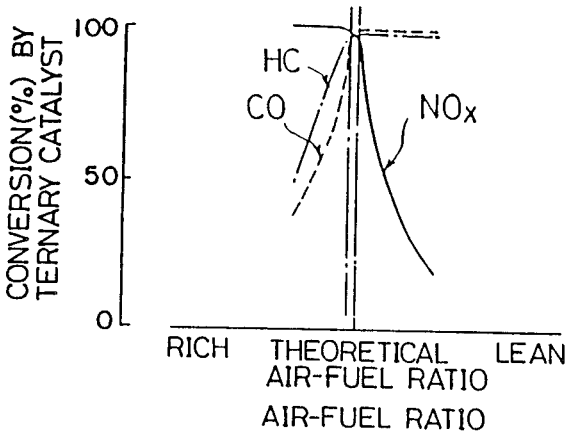
FIG. 7 is a diagram illustrating the characteristics of a ternary catalyst used in the embodiment shown in FIG. 2.

If the arrangement in this embodiment is adopted, in the region where the $NO_x$ concentration in the exhaust gas is high, the abrupt output reversion characteristic of the oxygen sensor 19 between the high and low levels is shifted to the richer side by the $NO_x$-reducing catalyst layer 5 compared to that in the conventional oxygen sensor without $NO_x$-reducing catalyst layer. In addition, the reference value is shifted to a level $SL_H$ corresponding to a richer air-fuel ratio than the theoretical air-fuel ratio. Furthermore, since first feedback control constants $P_R$ and $I_R$ for increasing the fuel injection quantity for correction are set at values larger than the second feedback control constants $P_L$ and $I_L$ for decreasing the fuel quantity for correction respectively, the ratio of the air-fuel ratio-rich period in the air-fuel ratio feedback control is increased (see FIG. 9). Accordingly, the driving state region of maps in steps 12 and 13 where the conversion of $NO_x$ is sufficiently high in the ternary catalyst 20 is used, as shown in FIG. 7; and therefore, a good $NO_x$-reducing function can be maintained stably even if there is a dispersion in parts or the like.

Since the second slice level $SL_H$ is adjusted to a level corresponding to an air-fuel ratio richer by up to 5% than the theoretical air-fuel ratio, the problem of increased amounts of discharged CO and HC by a too rich air-fuel ratio can be prevented.

Figure 6:
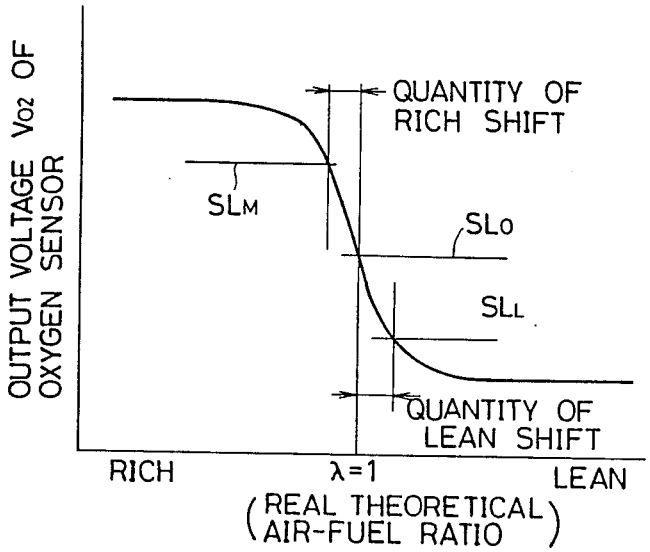
FIG. 6 is a diagram illustrating the characteristics of the oxygen sensor in the embodiment shown in FIG. 2.
Figure 8:
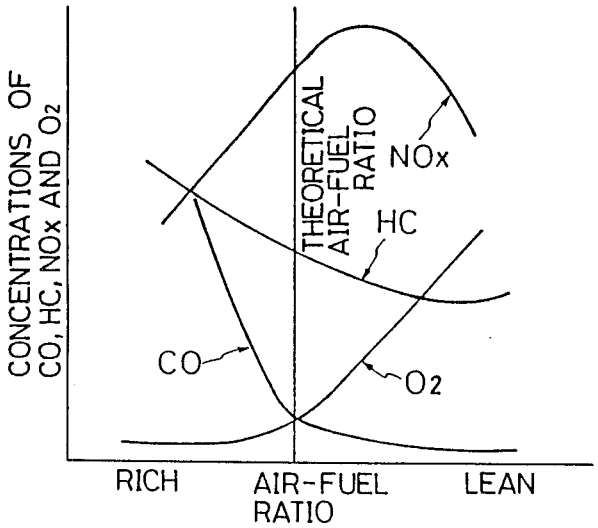
FIG. 8 is a diagram illustrating the concentration characteristics of various exhaust gas components.

On the other hand, in the region where the CO and HC concentrations are high, as shown in FIG. 8, the abrupt output reversion characteristic of the oxygen sensor 19 between the high and low levels is shifted to the leaner side, because the second slice level $SL_L$ is shifted to a level corresponding to an air-fuel ratio leaner than the theoretical air-fuel ratio as shown in FIG. 6. Moreover, the second feedback control constant $P_L$ and $I_L$ are set at levels larger than the first feedback control constant $P_R$ and $I_R$. Accordingly, the ratio of the air-fuel ratio-lean time is increased (see FIG. 10). As a result, the region where the conversions of CO and HC are sufficiently high in the ternary catalyst 20 is used, as shown in FIG. 7, and a good CO— and HC-reducing function can be maintained stably even if there is a dispersion in parts or the like.

Also in this case, if the slice level $SL_L$ is set at a level corresponding to an air-fuel ratio unnecessarily shifted to the lean side, since the air-fuel ratio is made too lean, the decrease of the $NO_x$-reducing reaction in the $NO_x$-reducing catalyst layer by a decrease of the amounts of formed CO and HC which can react to reduce $NO_x$ becomes conspicuous, and the rich-shifting effect of the oxygen sensor with the $NO_x$ reducing capacity is lost. According to the present invention, however, this trouble can be obviated by setting the second reference value $SL_L$ at a level corresponding to an air-fuel ratio leaner by up to 5% than the theoretical air-fuel ratio, and the amount of $NO_x$ can be controlled below the allowable level.

More specifically, by setting the second slice levels $SL_H$ and $SL_L$ at a level corresponding to an air-fuel ratio richer or leaner by up to 5% than the theoretical air-fuel ratio, the $NO_x$-reducing reaction by the $NO_x$-reducing catalyst layer is promoted. Therefore, even if an EGR apparatus or the like is not disposed, the function of reducing the amounts of CO and HC can be enhanced while maintaining a good $NO_x$-reducing function. Accordingly, the amounts of CO, HC and $NO_x$ can be reduced with a good balance over the entire driving region and the overall exhaust gas emission performance can be highly improved.

Incidentally, as may be easily understood from the foregoing description, either one of setting feedback control constants $P_R$, $P_L$, $I_R$ and $I_L$ at different values respectively, and setting the slice levels $SL_H$ and $SL_L$, is sufficient for effectively setting the second target air-fuel ratio, instead of both being set.

As means for improving fuel consumption characteristic, there is known a method in which the ignition timing is controlled to the advance side in the normal driving region. In this method, however, the amount of $NO_x$ increases with elevation of the combustion temperature. If the control is carried out according to the present invention, the amount of $NO_x$ can be reduced and the present invention makes contributions to the improvement of the fuel consumption characteristic.

In an engine in which surging (longitudinal vibration of a car body) is often caused and the combustion stability is bad, surging can be controlled by advancing the ignition timing. Also in this case, the amount of $NO_x$ is increased, but if the present invention is adopted, the amount of $NO_x$ can be reduced by the above-mentioned control. Accordingly, the present invention makes contributions to the control of surging.

We claim:

1. An electronic air-fuel ratio control apparatus in an internal combustion engine with a ternary catalyst disposed in an exhaust system which is effective in oxidation reaction of carbon oxide and hydro carbon and in reduction reaction of nitrogen oxides when an air-fuel mixture drawn into the engine is in a theoretical air-fuel ratio, which comprises:

an engine driving state-detecting means for detecting a driving state of the engine;

a nitrogen oxides concentration detecting means for detecting nitrogen oxides concentration in the exhaust gas;

an incompletely burnt component concentration detecting means for detecting incompletely burnt component concentration including carbon oxide CO or hydro carbons HC in the exhaust gas;

an oxygen sensor disposed in the exhaust system of the engine to detect the air-fuel ratio of the air-fuel mixture through the oxygen concentration in the exhaust gas, said oxygen sensor comprising an oxidizing catalyst layer and a nitrogen oxides-reducing catalyst layer for promoting the reaction of reducing nitrogen oxides and emitting a voltage signal with the point of the theoretical air-fuel ratio corresponding to the oxygen concentration in the exhaust gas including the oxygen in the nitrogen oxides;

an air-fuel ratio feedback control means for controlling the air-fuel ratio of the air-fuel mixture by increasing or decreasing a fuel injection quantity to be supplied to the engine based on the engine driving state detected by said engine driving state-detecting means and the air-fuel ratio detected by said oxygen sensor so as to eliminate the deviation of the air-fuel ratio detected by said oxygen sensor from a target air-fuel ratio;

a fuel-injecting means for injecting and supplying a fuel to the engine in an on-off manner according to a driving pulse signal emitted from said air-fuel feedback control means; and said air-fuel ratio feedback control means in which the target air-fuel ratio has first and second target air-fuel ratios further comprising:

a first target air-fuel ratio setting means for setting the first target air-fuel ratio based on the engine driving state detected by said engine driving state detecting means and the air-fuel ratio detected by said oxygen sensor;

a second target air-fuel ratio setting means for changing the first air-fuel ratio to set the second target air-fuel ratio which is richer than the first air-fuel ratio when a high nitrogen oxides concentration is detected by said nitrogen oxides concentration detecting means or which is leaner than the first air-fuel ratio when a high incompletely burnt component concentration is detected by said incompletely burnt component concentration detecting means; and a fuel injection quantity computing means for computing and setting a fuel injection quantity to be injected from said fuel-injecting means to the engine to attain the first target air-fuel ratio or the second target air-fuel ratio of the air-fuel mixture based on the engine driving state, the air-fuel ratio of the air-fuel mixture, the nitrogen oxide concentration and the incompletely burnt component concentration.

2. An electronic air-fuel ratio control apparatus as set forth in claim 1 wherein said second target air-fuel ratio setting means sets the second air-fuel ratio to a valve which is richer than the theoretical air-fuel ratio by up to 5% when a high nitrogen oxides concentration is detected.

3. An electronic air-fuel ratio control apparatus as set forth in claim 1 wherein said second target air-fuel ratio setting means sets the second air-fuel ratio to a value richer than the theoretical air-fuel ratio in response to the nitrogen oxides concentration when the higher nitrogen oxides concentration is detected.

4. An electronic air-fuel ratio control apparatus as set forth in claim 1 wherein said second target air-fuel ratio setting means sets the second air-fuel ratio to a value which is leaner than the theoretical air-fuel ratio by up to 5% when a high incompletely burnt component concentration is detected.

5. An electronic air-fuel ratio control apparatus as set forth in claim 1 wherein said second target air-fuel ratio setting means sets a second air-fuel ratio to the value leaner than the theoretical air-fuel ratio in response to the incompletely burnt component concentration when a high incompletely burnt component concentration is detected.

6. An electronic air-fuel ratio control apparatus as set forth in claim 1 wherein said air-fuel ratio feedback control means further comprises an air-fuel ratio judging means for comparing the voltage signal $V_{02}$ from said oxygen sensor with a slice level SL as a reference value to judge whether the air-fuel ratio of the air-fuel mixture is richer or leaner than the slice level SL, and an air-fuel ratio feedback control correction coefficient setting means for setting an air-fuel ratio feedback control correction coefficient LAMBDA so as to eliminate the deviation of the air-fuel ratio detected by said oxygen sensor from the target air-fuel ratio in a manner of an integration control.

7. An electronic air-fuel ratio control apparatus as set forth in claim 6 wherein said fuel injection quantity computing means computes a fuel injection quantity Ti as the following formula;

$$Tp = K.Q/N$$

$$Ti = Tp.\mathrm{COEF.LAMBDA} + Ts$$

where K stands for a constant, Q stands for a quantity of air drawn into the engine and detected by said engine driving state detecting means, N stands for an engine revolution number detected by said engine driving state detecting means, Tp stands for a basic fuel injection quantity, COEF stands for correction coefficients of engine driving states and Ts stands for a correction quantity pertaining to a fluction of a battery voltage for the engine.

8. An electronic air-fuel ratio control apparatus as set forth in claim 6 wherein the slice level SL has first and second slice levels said first target air-fuel ratio setting means comprises means for setting first slice level $SL_O$, and said second target air-fuel ratio setting means is means for setting a second slice level $SL_H$ higher than the first slice level $SL_O$ so that the second target air-fuel ratio is set in a side richer than the theoretical air-fuel ratio.

9. An electronic air-fuel ratio control apparatus as set forth in claim 8 wherein said second slice level $SL_H$ is changeably set in accordance with the nitrogen oxides concentration.

10. An electronic air-fuel ratio control apparatus as set forth in claim 6 wherein the slice level SL has first and second slice levels and said first target air-fuel ratio setting means comprises means for setting slice level $SL_O$, and said second target air-fuel ratio setting means is means for setting the second slice level $SL_L$ lower than the first slice level $SL_O$, so that the second target air-fuel ratio is set in a side leaner than the theoretical air-fuel ratio.

11. An electronic air-fuel ratio control apparatus as set forth in claim 10 wherein said second slice level $SL_L$ is changeably set in accordance with the concentration of the incompletely burnt component.

12. An electronic air-fuel ratio control apparatus as set forth in claim 6 wherein said air-fuel ratio feedback control correction coefficient has first and second coefficients, said first target air-fuel ratio setting means comprises means for setting the first air-fuel ratio feedback control correction coefficient LAMBDA which is increased or decreased in a manner of integration feedback control in every air-fuel ratio feedback control routing and said second air-fuel ratio setting means comprises means for setting the second air-fuel ratio feedback control correction coefficient LAMBDA in every air-fuel ratio feedback control routine, which is increased or decreased by first and second feedback control constants, said first feedback control constant being set to a larger value when a high nitrogen oxides concentration is detected and when the air-fuel ratio feedback control is performed in the direction of increasing the fuel injection quantity rather than the second feedback control constant set when the air-fuel ratio feedback control is performed in the direction of decreasing the fuel injection quantity.

13. An electronic air-fuel ratio control apparatus as set forth in claim 6 wherein the air-fuel ratio feedback control correction coefficient has first and second coefficients, said first target air-fuel ratio setting means comprises means for setting the first air-fuel ratio feedback control correction coefficient LAMBDA which is increased or decreased in a manner of integration feedback control in every air-fuel ratio feedback control routine and said second air-fuel ratio setting means comprises for setting the second air-fuel ratio feedback control correction coefficient LAMBDA in every air-fuel ratio feedback control routine, which is increased or decreased by first and second feedback control constants, the first feedback control constant being set to a larger value when the incompletely burnt component concentration is detected and when the air-fuel ratio feedback control is performed in the direction of decreasing the fuel injection quantity rather than the second feedback control constant set when the air-fuel ratio feedback control is performed in the direction of increasing the fuel injection quantity.

14. An electronic air-fuel ratio control apparatus as set forth in claim 1 wherein said nitrogen oxides concentration detecting means comprises means for detecting predetermined engine driving regions where high nitrogen oxides concentration is emitted in the exhaust gas from the engine.

15. An electronic air-fuel ratio control apparatus as set forth in claim 1 wherein said incompletely burnt component concentration detecting means comprises means for detecting predetermined engine driving regions where high incompletely burnt component concentration is emitted in the exhaust gas from the engine.

16. An electronic air-fuel ratio control apparatus as set forth in claim 1 wherein said oxygen sensor comprises a substrate composed of a solid electrolyte having an oxygen ion-conducting property, an oxidation catalyst layer for promoting the oxidation reaction of the incompletely burnt component such as carbon oxide and hydrocarbons in the exhaust gas, which is formed on the exhaust gas-contacting outer surface of the substrate, and a $NO_x$-reducing catalyst layer for promoting the reduction reaction of $NO_x$ in the exhaust gas, which is laminated on the oxidation catalyst layer, the oxygen sensor having a structure such that the electromotive force generated between the exhaust gas-contacting outer surface of the substrate and the air-contacting inner surface of the substrate is taken out as the output value.

17. An electronic air-fuel ratio control apparatus in an internal combustion engine with a ternary catalyst disposed in an exhaust system which is effective in oxidation reaction of carbon oxide and hydro carbon and in reduction reaction of nitrogen oxides when an air-fuel mixture drawn into the engine is in a theoretical air-fuel ratio, which comprises:

an engine driving state-detecting means for detecting a driving state of the engine;

an incompletely burnt component concentration detecting means for detecting incompletely burnt component concentration including carbon oxide CO or hydro carbons HC in the exhaust gas;

an oxygen sensor disposed in the exhaust system of the engine to detect the air-fuel ratio of the air-fuel mixture through the oxygen concentration in the exhaust gas, said oxygen sensor comprising an oxidizing catalyst layer and a nitrogen oxides-reducing catalyst layer for promoting the reaction of reducing nitrogen oxides and emitting a voltage signal with the point of the theoretical air-fuel ratio corresponding to the oxygen concentration in the exhaust gas including the oxygen in the nitrogen oxides;

an air-fuel ratio feedback control means for controlling the air-fuel ratio of the air-fuel mixture by increasing or decreasing a fuel injection quantity to be supplied to the engine based on the engine driving state detected by said engine driving state-detecting means and the air-fuel ratio detected by said oxygen sensor so as to eliminate the deviation of the air-fuel ratio detected by said oxygen sensor from a target air-fuel ratio;

a fuel-injecting means for injecting and supplying a fuel to the engine in an on-off manner according to a driving pulse signal emitted from said air-fuel feedback control means; and said air-fuel ratio feedback control means in which the target air-fuel ratio has first and second target air-fuel ratios further comprising:

a first target air-fuel ratio setting means for setting the first target air-fuel ratio based on the engine driving state detected by said engine driving state detecting means and the air-fuel ratio detected by said oxygen sensor;

a second target air-fuel ratio setting means for changing the first air-fuel ratio to set the second target air-fuel ratio which is leaner than the first air-fuel ratio when a high incompletely burnt component concentration is detected by said incompletely burnt component concentration detecting means; and a fuel injection quantity computing means for computing and setting a fuel injection quantity to be injected from said fuel-injecting means to the engine to attain the first target air-fuel ratio or the second target air-fuel ratio of the air-fuel mixture based on the engine driving state, the air-fuel ratio of the air-fuel mixture, and the incompletely burnt component concentration.

18. An electronic air-fuel ratio control apparatus in an internal combustion engine with a ternary catalyst disposed in an exhaust system which is effective in oxidation reaction of carbon oxide and hydro-carbons and in reduction reaction of nitrogen oxides when an air-fuel mixture drawn into the engine is a theoretical air-fuel ratio, which includes:

an engine driving state-detecting means for detecting a driving state of the engine;

an oxygen sensor disposed in the exhaust system of the engine to detect the air-fuel ratio of the air-fuel mixture through the oxygen concentration in the exhaust gas;

an air-fuel ratio feedback control means for controlling the air-fuel ratio of the air-fuel mixture by increasing or decreasing a fuel injection quantity to be supplied to the engine based on the engine driving states detected by said engine driving state-detecting means and the air-fuel ratio detected by said oxygen sensor so as to eliminate the deviation of the air-fuel ratio detected by said oxygen sensor from a target air-fuel ratio; and a fuel-injecting means for injecting and supplying a fuel to the engine in an on-off manner according to a driving pulse signal emitted from said air-fuel feedback control means;

an incompletely burnt component concentration detecting means for detecting an incompletely burnt component concentration including carbon oxide CO or hydrocarbons HC in the exhaust gas is further comprised;

said oxygen sensor comprises a nitrogen oxides-reducing catalyst layer for promoting the reaction of reducing nitrogen oxides and emitting a voltage signal with the point of the theoretical air-fuel ratio corresponding to the oxygen concentration in the exhaust gas including the oxygen in the nitrogen oxides, said air-fuel ratio feedback control means has first and second target air-fuel ratios as said target air-fuel ratio and comprises:

a first target air-fuel ratio setting means for setting the first target air-fuel ratio based on the engine driving state detected by said engine driving state detecting means and the air-fuel ratio detected by said oxygen sensor;

a second target air-fuel ratio setting means for changing the first air-fuel ratio to set the second target air-fuel ratio richer than the first air-fuel ratio at least when the high nitrogen oxides concentration is detected by said nitrogen oxides concentration detecting means or leaner than the first air-fuel ratio when the high incompletely burnt component concentration is detected by said incompletely burnt component concentration detecting means; and a fuel injection quantity computing means for computing and setting a fuel injection quantity to be injected from said fuel-injecting means to the engine to attain the first target air-fuel ratio or the second target air-fuel ratio of the air-fuel mixture based on the engine driving state, the air-fuel ratio of the air-fuel mixture and the nitrogen oxide concentration.

* * * * *